US006135893A

United States Patent [19]

Probert

[11] Patent Number: 6,135,893

[45] Date of Patent: Oct. 24, 2000

[54] GOLF COURSE PACE OF PLAY TRACKING SYSTEM AND METHOD

[76] Inventor: Carl F. Probert, 11009 Haney Ter., Damascus, Md. 20872

[21] Appl. No.: 09/333,897

[22] Filed: Jun. 16, 1999

Related U.S. Application Data

[60] Provisional application No. 60/090,146, Jun. 22, 1998.

[51] Int. Cl.[7] ..... A63B 69/36

[52] U.S. Cl. ..... 473/131; 473/409

[58] Field of Search ..... 473/131, 409, 473/405, 407, 168, 169; 368/44; 273/DIG. 26

[56] References Cited

U.S. PATENT DOCUMENTS

| | | | |
|---|---|---|---|
| 4,303,243 | 12/1981 | Wolfe | 473/150 |
| 5,094,451 | 3/1992 | Glamack | 473/407 |
| 5,357,487 | 10/1994 | Coleman, III | 473/131 |
| 5,386,990 | 2/1995 | Smith . | |
| 6,033,316 | 3/2000 | Nixon | 473/131 |

*Primary Examiner*—Steven Wong
*Attorney, Agent, or Firm*—Donald A. Kettlestrings

[57] ABSTRACT

A system and method for tracking the pace of play of a plurality of groups of golfers on a golf course for the purpose of eliminating slow play provides a medium having a plurality of columns of numbers thereon representing expected tee-times for a plurality of golf holes for each of the plurality of groups. An additional column of numbers on the medium represents expected finishing times for each of the plurality of groups, and a second additional column of defined spaces is provided on the medium for inserting identifying indicia for each of the plurality of groups. Actual tee-times of the groups are marked by a golf course advisor in the plurality of columns on the medium as the groups tee-off on various of the golf course holes, and adjacent ones of the marked actual tee-times for each group are connected together by the course advisor by marking straight lines on the medium to provide a graph line showing the actual pace of play of each group. That graph line is visually compared to the pace line of the group, which is a line extending through the expected tee-times of the group, to determine if the pace of play of the group is too slow. If the pace of play of the group is too slow, the course advisor can also determine if the slow pace of play of the group is affecting the pace of play of a following group or groups.

8 Claims, 4 Drawing Sheets

GOLF COURSE PACE OF PLAY TRACKING SYSTEM AND METHOD

This application claims benefit of provisional application 60/090146, filed Jun. 22, 1998.

BACKGROUND OF THE INVENTION

This invention relates to the game of golf and more particularly to a system and method for tracking the pace of play of a plurality of groups of golfers on a golf course for the purpose of eliminating slow play.

Eliminating slow play on the golf course is a goal sought after by both players and golf course owners. Eliminating slow play greatly enhances the golfing experience for the golfer and allows full course utilization for the owner.

It is, therefore, an object of the present invention to provide a system and method for tracking the pace of play of a plurality of groups of golfers on a golf course for the purpose of eliminating slow play.

Another object is to provide such a system and method which will provide the golf course staff with a visual representation of the pace of play of all groups on the golf course as play progresses.

A further object of the invention is the provision of such a system and method which enables slow play and its affect on the golf course to be quickly identified and managed.

Still another object is to provide such a system and method which addresses all causes of slow play.

Another object is to provide such a system and method which provides a course advisor with a "real time" graph of course activity.

A further object is to provide such a system and method which provides a course advisor with information needed to make objective decisions about slow play.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a system and method for tracking the pace of play of a plurality of groups of golfers on a golf course for the purpose of eliminating slow play wherein the system comprises: a medium having a plurality of columns of numbers thereon representing expected tee-times for a plurality of golf holes for each of the plurality of groups; a first additional column of numbers on the medium representing expected finishing times for each of the plurality of groups; a second additional column of defined spaces on the medium for inserting identifying indicia for each of the plurality of groups; and means for inserting the identifying indicia into the second additional column of defined spaces on the medium and for tracking the pace of play of the plurality of groups by marking actual tee-times of the groups in predetermined of the plurality of columns on the medium as the groups tee-off on various of the golf course holes and by connecting together adjacent ones of the actual marked tee-times on the medium for each group by a straight line to create a graph line that is visually compared to a pace line of the group, which is a line extending through the expected tee-times of the group, whereby a course advisor can determine if the pace of play of the group is too slow and if the pace of play of the group is affecting a following group or groups.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

Figure 1:
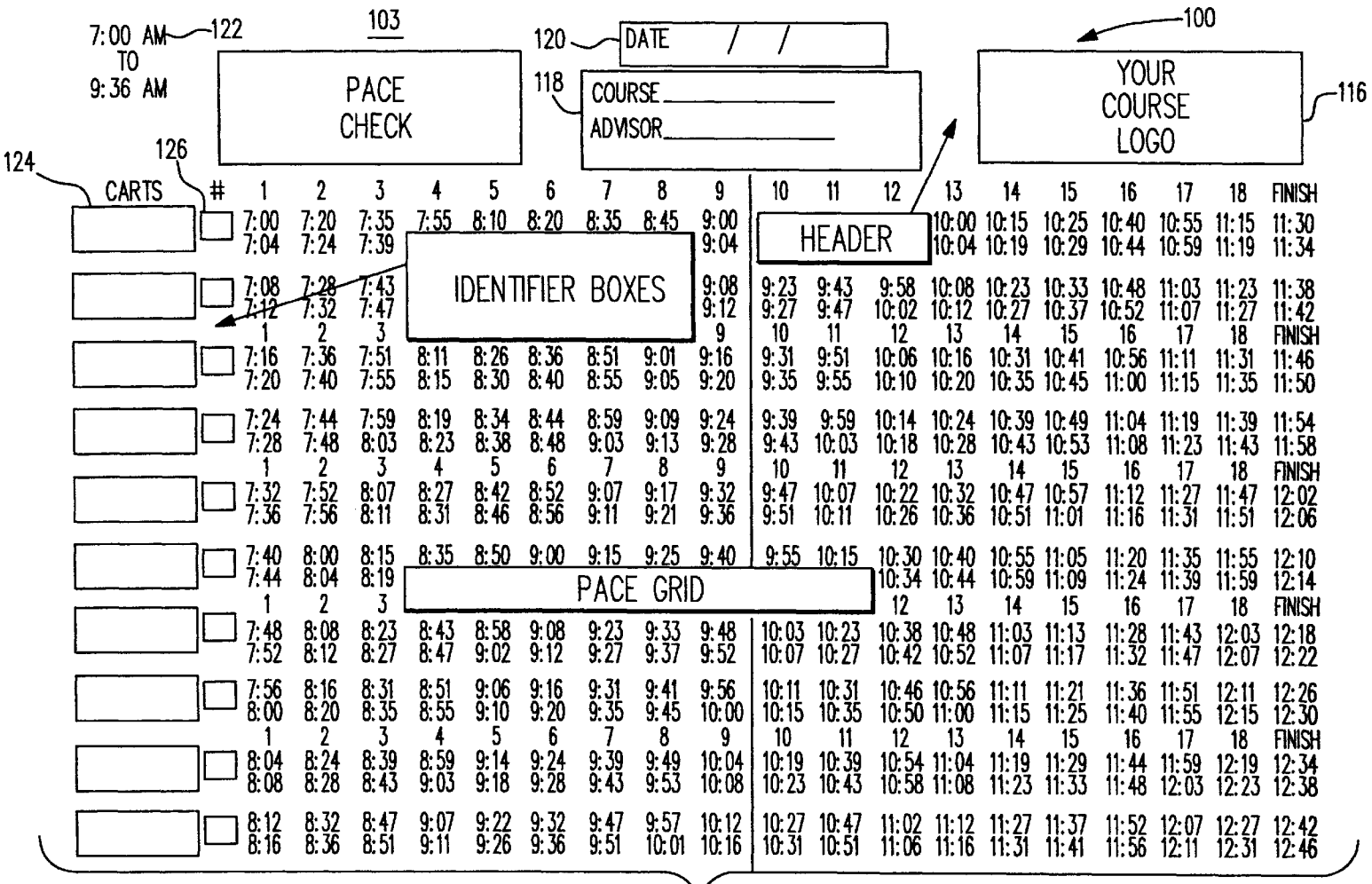
FIGS. 1 and 1A show the system of this invention and shows a representative pace sheet for use on an illustrative golf course with a plurality of groups of golfers playing eighteen holes and with expected tee-times on hole number one from 7:00 a.m. to 9:36 a.m.
Figure 1A:
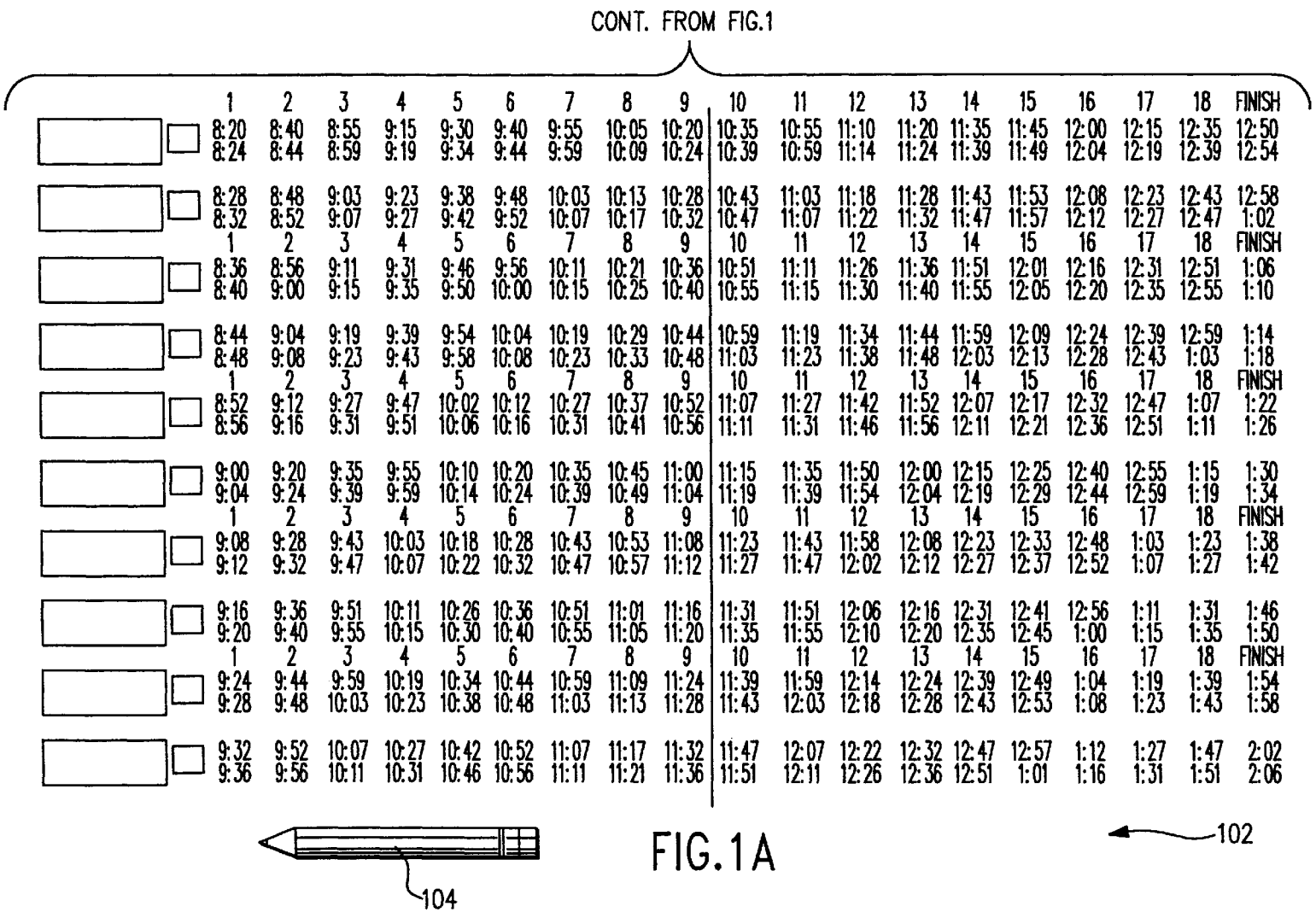

The representative pace sheet shown in FIGS. 1 and 1A will be supplemented with additional pace sheets, not shown, which will similarly contain first hole expected tee-times after 9:36 a.m. and which will contain the last expected finish time of the day in the lower right corner of the last pace sheet. The actual expected tee-times for all groups, as shown on the pace sheets, will vary depending on the golf course and the separation of expected tee-times established by the golf course administrators.

The vertical separation of the expected tee-times in the pace grid of expected tee-times on the pace sheet shown in FIGS. 1 and 1A is preferably equal to one-half the course's scheduled or expected tee-times. In FIGS. 1 and 1A, for example, the course separates tee-times by eight minutes. Therefore, the pace grid expected tee-times are preferably separated vertically in each hole column by four minutes. The horizontal separation of the times in the pace grid columns is equal to the amount of time allocated to play each hole. In FIGS. 1 and 1A, for example, the course allows ten minutes to play a par three hole, fifteen minutes to play a par four hole and twenty minutes to play a par five hole. Each row of times in the pace grid represents the expected tee-times for eighteen golf holes, plus the expected finish time for the round of eighteen holes. The columns are labeled one through eighteen and finish. Of course, each golf course could establish different time periods to play par three, par four and par five holes, and the expected tee-times and finish times in the nineteen pace grid columns on each pace sheet would be different than those shown in FIGS. 1 and 1A.

DESCRIPTION OF THE PREFERRED EMBODIMENT

With reference now to the drawings, wherein like reference characters designate like or corresponding parts throughout the several views, there is shown in FIGS. 1, 1A, 2 and 2A a system 100 for enabling tracking of the pace of play of a plurality of groups of golfers on a golf course for the purpose of eliminating slow play.

In accordance with the invention, system 100 includes a medium 102, such as paper, plastic, MYLAR or MYLAR strips, laminated hardboard, a computer screen, or any other suitable medium, having a plurality of columns (1–18) of numbers thereon representing expected tee-times for eighteen golf holes for each of a plurality of groups of golfers.

System 100 further includes a first additional column (Finish) of numbers on medium 102 representing expected finishing times for each of the plurality of groups. A second additional column of defined spaces (Carts) is provided on medium 102 for inserting identifying indicia for each of the plurality of groups. Medium 102, containing columns 1–18, the Finish column and the Carts column, is a pace sheet 103.

System 100 further includes means 104, such as a pen, pencil or other known marking instrument, for inserting the identifying indicia into the Carts column of defined spaces on medium 102. Means 104 is also used for tracking the pace of play of the plurality of groups of golfers by marking actual tee-times of the groups in predetermined of the plurality of columns numbered 1–18 on medium 102 as the groups tee-off on various of the golf course holes and by connecting together adjacent ones of the actual marked tee-times on medium 102 for each group by a straight line to create a graph line. See FIGS. 2 and 2A which illustrate graph lines 106, 108, 110, 112 and 114 for five different groups of golfers.

Each pace sheet 103, such as that shown in FIGS. 1 and 1A, can be of different lengths than that shown in FIGS. 1 and 1A so that fewer or greater numbers of actual starting tee-times will be included on each pace sheet 103. Each pace sheet 103 can include color, and the example shown in FIGS. 1 and 1A is a pace sheet on 8½ inches by 11 inches sheets of paper.

Each pace sheet 103 preferably includes a defined space 116 for the name or logo of the golf course, an additional defined space 118 for the name of the golf course advisor or staff person using pace sheet 103, a further defined space 120 for the date, and still another defined space 122 for indicating the total period of time of actual starting tee-times on hole number one that are contained on the particular pace sheet 103.

The staff person using system 100 and using pace sheets 103, illustrated in FIGS. 1, 1A, 2 and 2A, will hereinafter be referred to as the course advisor. Course marshals, course rangers, and course advisors are synonymous for this staff position, depending on the golf course. There are two aspects of usage of system 100 and of pace sheets 103 illustrated in FIGS. 1, 1A, 2 and 2A. The first is establishing the group pace line, and the second is tracking the group through the golf course by plotting the group's graph line and then comparing the graph line with the pace line.

In establishing the group pace line, the course advisor will indicate the time a group actually tees-off at the first hole in the first column headed 1 of the pace grid. For example, the actual tee-time will be indicated by circling the time on pace sheet 103 closest to the actual tee-time. The course advisor will then identify the group by inserting the group's Cart numbers and the number of players in the group in the two identifier boxes 124, 126, respectively, to the left of the circled tee-time. Marker 104 will be used for this purpose. The identifier boxes 124, 126 and the two rows of times to the right of those boxes on pace sheet 103 shown in FIGS. 1, 1A, 2 and 2A, establishes the group's pace line. The group's pace line is a line extending through the expected tee-times of the group through columns 1–18. See FIGS. 2 and 2A. The beginning of the group's pace line and the beginning of the group's graph line is the circled actual tee-time of the group in hole 1.

Tracking of the group as it plays through the golf course is accomplished by the course advisor as he travels through the course. As he travels through the course, the course advisor marks the actual tee-times of the group at various holes onto pace sheet 103 with marker 104. For example, if a group is teeing-off on the eighth hole, the course advisor will look down the eighth column on the pace grid on pace sheet 103, locate the closest tee-time and circle it. When the course advisor encounters a group that is not at the tee, the course advisor will estimate the last tee-time for that group and will circle that time in the appropriate column. A connection will then be made by the course advisor by drawing a straight line between the group's last two circled tee-times with marker 104. As play progresses, the connections between actual tee-times of the group drawn by marker 104 will develop a graph line showing the group's progress and the effect the group's pace of play has had on the other following groups on the course.

The developing graph line for any group is expected to track on or above the group's pace line, indicating that the group has not fallen behind the expected pace of play. When the graph line falls below the group's pace line, indicating slow play, the course advisor can objectively evaluate if the slow play has an adverse effect on other following groups and if intervention is required to speed up play. See FIGS. 2 and 2A.

Figure 2:
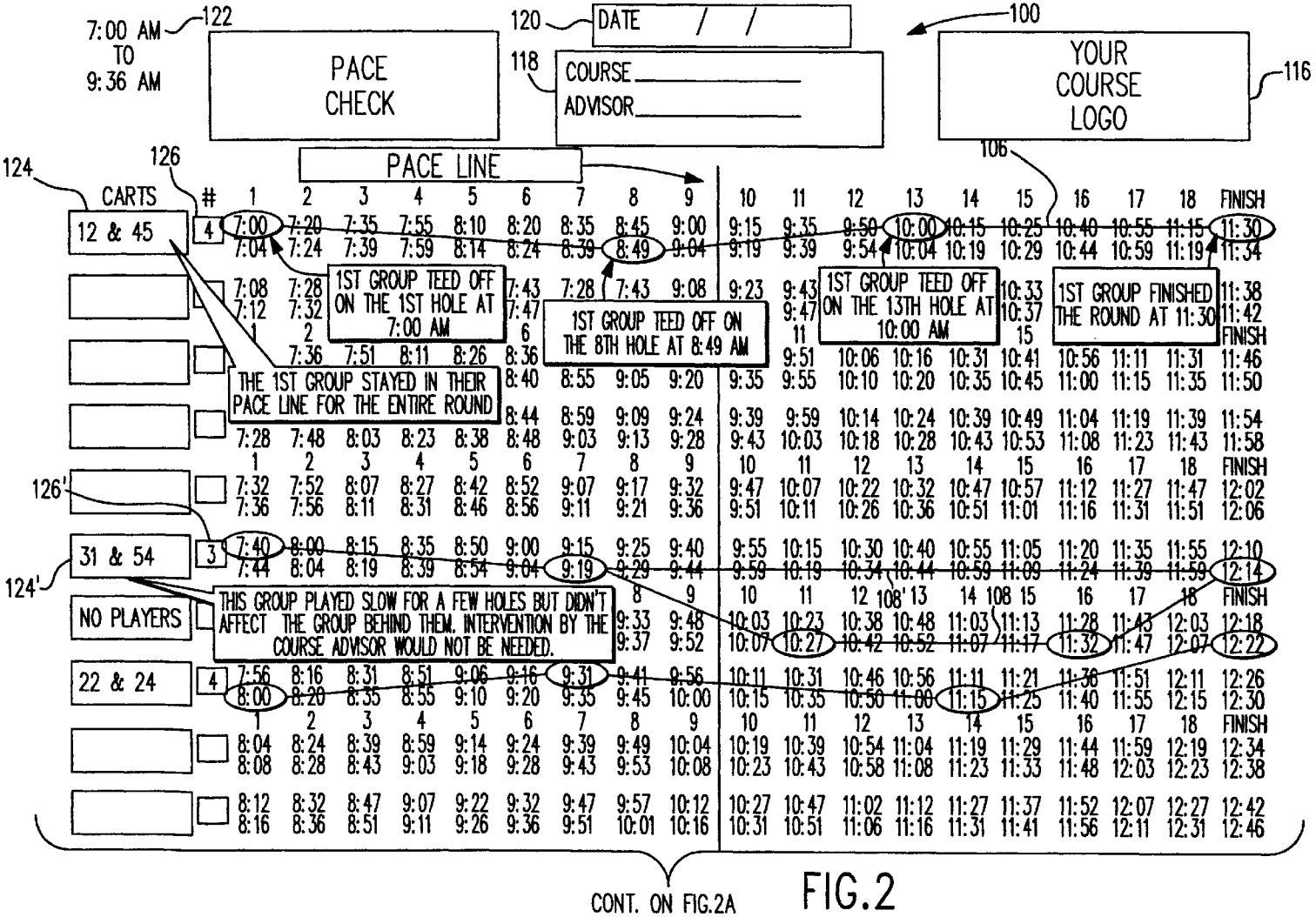
FIGS. 2 and 2A show the system and pace sheet illustrated in FIGS. 1 and 1A but with the addition of illustrative groups of players and showing pace lines and graph lines tracking the pace of play of those groups of players as they play the eighteen hole golf course.
Figure 2A:
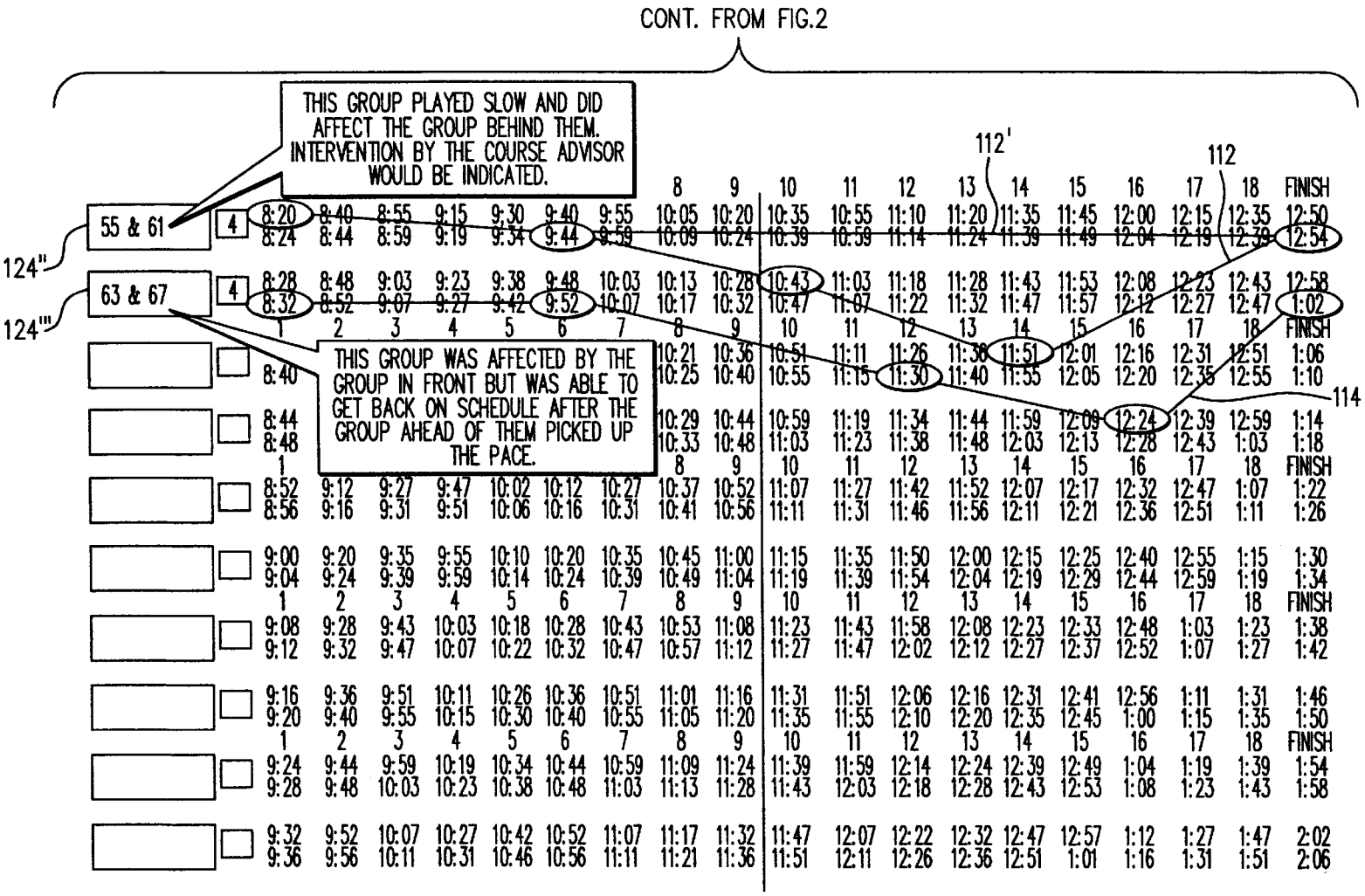

With reference to FIGS. 2 and 2A, graph line 106 tracking the pace of play of the group identified in identifier box 124 shows that the group has played the entire eighteen holes within its pace line. In this instance, graph line 106 coincides with the group's pace line and does not fall below the pace line or expected pace of play for the group.

The group of players identified within identifier box 124' has played slowly for a few holes, but their slow play didn't affect the group behind them because there were no players behind them. Therefore, intervention by the course advisor would not be needed even though the group's graph line 108 falls below their pace line 108'.

The group identified in identifier box 124" played too slowly and did affect the group behind them. This can be seen in FIGS. 2 and 2A because their graph line 112 fell below their pace line 112'. Intervention by the course advisor would be indicated.

The group identified within identifier box 124'" was affected by the group in front of them, identified in identifier box 124". But the group identified in box 124'" was able to get back on schedule after the group ahead of them picked up the pace.

The system and method of this invention enables the problem of slow play to be adjusted through the management of slow play rather than attempting to prevent it by other means. The system and method of this invention is an improvement over other pace of play systems or devices because it addresses all causes of slow play. The real time graph of course activity developed by this system and method provides the course advisor with the information needed to make objective decisions as to whether or not intervention is required to speed up the pace of play of a particular group.

The invention in its broader aspects is not limited to the specific details shown and described, and departures may be made from such details without departing from the principles of the invention and without sacrificing its chief advantages.

What is claimed is:

1. A system for enabling tracking of the pace of play of a plurality of groups of golfers on a golf course for the purpose of eliminating slow play, said system comprising:

a medium having a plurality of columns of numbers thereon representing expected tee-times for a plurality of golf holes for each of said plurality of groups;

a first additional column of numbers on said medium representing expected finishing times for each of said plurality of groups;

a second additional column of defined spaces on said medium for inserting identifying indicia for each of said plurality of groups; and means for inserting said identifying indicia into said second additional column of defined spaces on said medium and for tracking the pace of play of said plurality of groups by marking actual tee-times of said groups in predetermined of said plurality of columns on said medium as said groups tee-off on various of said golf course holes and by connecting together adjacent ones of said actual marked tee-times on said medium for each said group by a substantially straight line to create a graph line that is visually compared to a pace line of said group, which is a line extending through the expected tee-times of said group, whereby a course advisor can determine if the pace of play of said group is too slow and if the pace of play of said group is affecting the pace of play of a following group or groups.

2. A system as in claim 1 wherein said medium is paper and wherein said inserting means is a pen or pencil.

3. A system as in claim 1 wherein said medium is plastic and wherein said means is a marking instrument for marking on plastic.

4. A system as in claim 1 wherein said plurality of columns of numbers represents tee-times for eighteen golf holes.

5. A system as in claim 1 wherein each of said different spaces in said second additional column defines two identifier boxes for each of said groups for receiving cart numbers and number of persons in each of said groups.

6. A method for tracking the pace of play of a plurality of groups of golfers on a golf course for the purpose of eliminating slow play, said system comprising the steps of:

providing a medium having a plurality of columns of numbers thereon representing expected tee-times for a plurality of golf holes for each of said plurality of groups;

providing a first additional column of numbers on said medium representing expected finishing times for each of said plurality of groups;

providing a second additional column of defined spaces on said medium for inserting identifying indicia for each of said plurality of groups;

inserting said identifying indicia into said second additional column of defined spaces on said medium;

tracking the pace of play of said plurality of groups by marking actual tee-times of said groups in predetermined of said plurality of columns on said medium as said groups tee-off on various of said golf course holes and by connecting together adjacent ones of said actual marked tee-times on said medium for each said group by a substantially straight line to create a graph line; and visually comparing said graph line to a pace line, which is a line extending through said expected tee-times of said group, to determine if the pace of play of said group is too slow.

7. A method as in claim 6 wherein said plurality of columns of numbers represents tee-times for eighteen golf holes.

8. A method as in claim 7 wherein said identifying indicia includes cart numbers and the number of persons in each of said groups.

* * * * *